US006165291A

United States Patent [19]

Jin et al.

[11] Patent Number: 6,165,291

[45] Date of Patent: Dec. 26, 2000

[54] PROCESS OF PRODUCING ALUMINUM FIN ALLOY

[75] Inventors: Iljoon Jin; Kevin Gatenby; Toshiya Anami, all of Kingston, Canada; Yoshito Oki, Fuji, Japan

[73] Assignee: Alcan International Limited, Montreal, Canada

[21] Appl. No.: 09/489,119

[22] Filed: Jan. 21, 2000

Related U.S. Application Data

[63] Continuation-in-part of application No. 09/121,638, Jul. 23, 1998.

[51] Int. Cl.[7] ..... C22F 1/04

[52] U.S. Cl. ..... 148/551; 148/552; 148/692; 148/696

[58] Field of Search ..... 148/551, 552, 148/692, 696

[56] References Cited

U.S. PATENT DOCUMENTS

| | | |
|---|---|---|
| 3,989,548 | 11/1976 | Morris . |
| 4,021,271 | 5/1977 | Roberts . |
| 4,126,487 | 11/1978 | Morris et al. . |
| 4,802,935 | 2/1989 | Crona et al. . |
| 5,217,547 | 6/1993 | Ishikawa et al. . |
| 5,681,405 | 10/1997 | Newton et al. . |

FOREIGN PATENT DOCUMENTS

| | | |
|---|---|---|
| 0 637 481 | 1/1994 | European Pat. Off. . |
| 2-025546 | 1/1990 | Japan . |
| 3-028352 | 2/1991 | Japan . |
| 3-031454 | 2/1991 | Japan . |
| 3-100143 | 4/1991 | Japan . |
| 6-136492 | 5/1994 | Japan . |
| 1 524 355 | 9/1978 | United Kingdom . |

OTHER PUBLICATIONS

Patent abstracts of Japan vol. 018, No. 344 (C–1218), Jun. 29, 1994 and JP 06 081064 A (Sky Alum Co. Ltd.), Mar. 22, 1994.

Patent abstracts of Japan vol. 015, No. 385 (C–0871), Sep. 27, 1991 and JP 03 153835 A (Mitsubishi Alum Co. Ltd.), Jul. 7, 1991.

Patent abstracts of Japan vol. 1995, No. 06, Jul. 31, 1995 and JP 07 070685 A (Mitsubishi Alum Co. Ltd.), Mar. 14, 1995.

*Primary Examiner*—George Wyszomierski
*Assistant Examiner*—Janelle Morillo
*Attorney, Agent, or Firm*—Cooper & Dunham LLP

[57] ABSTRACT

An aluminum alloy fin stock of lower (more negative) corrosion potential and higher thermal conductivity is produced by a process, which comprises continuously strip casting the alloy to form a strip, cold rolling the strip to an intermediate gauge sheet, annealing the sheet and cold rolling the sheet to final gauge. Lower corrosion potential and higher thermal conductivity are imparted by carrying out the continuous strip casting while cooling the alloy at a rate of at least 300° C./second, e.g. by conducting the casting step in a twin-roll caster.

10 Claims, 1 Drawing Sheet

PROCESS OF PRODUCING ALUMINUM FIN ALLOY

CROSS-REFERENCE TO RELATED APPLICATIONS

This application is a Continuation-in-Part under 35 USC §120 of patent application Ser. No. 09/121,638 filed Jul. 23, 1998, pending.

BACKGROUND OF INVENTION

1. Field of the Invention

This invention relates to a process of producing an improved aluminun alloy product for use in making heat exchanger fins, and a fin stock material so-produced having a tailored corrosion potential and preferably high conductivity.

2. Background Art

Aluminun alloys have long been used in the production of heat exchanger fins, e.g. for automotive radiators, condensers, evaporators etc. Traditional radiator fin alloys are designed to give high strength after brazing, good brazeability and a good sag resistance during brazing. Alloys used for this purpose usually contain a high level of manganese. An example is the aluminum alloy AA3003. Such alloys provide a good brazing performance; however, the thernal conductivity is relatively low. Low thermal conductivity has not been a serious problem in the past because of the significant thickness of the finstock material. If the material is of suitable thickness it can conduct a significant quantity of heat. However, in order to make vehicles lighter in weights there is a demand for thinner finstock material, and this has emphasised the need for improved thermal conductivity. Obviously, thinner gauge materials tend to impede heat flux as they become thinner.

Heat exchangers as well are designed for good corrosion performance, and this is frequently accomplished by making the fins of a material with a lower corrosion potential (more negative) than the remainder of the heat exchanger (making the fins sacrificial) and the fin material must therefore be tailored to the appropriate corrosion potential.

In the past, changes in the corrosion potential and conductivity of alloys have been brought about by changing the chemical composition of the alloys. For example, the inventors of the present application have previously found that specific aluminum alloys are particularly suitable for use in finstock material (as discussed in Applicants' prior unpublished U.S. patent application Ser. No. 09/121,638 filed Jul. 23, 1998, which is assigned to the same assignee as the present application, and which is incorporated herein by reference). These alloys contain Fe, Si, Mn and usually Zn and optionally Ti in particular content ranges. However, an improvement in the corrosion potential of heat exchanger made using fins of alloys of test kid and also an improvement in the thermal conductivity would make these and related alloys even more useful in meeting the stringent demands of the automotive industry.

SUMMARY OF THE INVENTION

It is an object of the present invention to modify the properties of aluminum alloy finstock by physical means (i e during fabrication of the fin stock) instead of, or in addition to, chemical means (i.e. by modify the constituents of the alloy).

Another object of the invention is to provide an aluminum alloy finstock material that has a lower (more negative) corrosion potential compared to alloys of identical or similar chemical composition.

Another object of the invention is to provide an aluminum alloy fin stock material that has improved thermal conductivity compared to alloys of identical or similar chemical composition.

Another object of the invention is to provide an aluminum alloy fin stock material that has a desired corrosion potential with less zinc content in the alloy.

Yet another object of the invention is to reduce (make more negative) the corrosion potential and/or increase the thermal conductivity of a finstock alloy while maintaining other desired properties, e.g. high strength and brazeability.

The present invention is based on the unexpected finding that the way in which a finstock alloy is cast to form an as-cast strip can affect the corrosion potential and/or thermal conductivity of the resulting alloy product, i.e. finstock sheet material. In particular it has been found that by casting an aluminum finstock alloy by a procedure that significantly elevates the conventional rate of alloy cooling during continuous casting, e.g. by means of twin-roll casting, the corrosion potential can be made much lower (more negative) and/or thermal conductivity of the alloy can be made much higher for given levels of alloying ingredients than has previously been observed.

Thus, according to one aspect of the invention, there is provided a process of producing an aluminum alloy fin stock sheet material from a finstock alloy, which comprises continuously strip casting molten alloy to form a continuous as-cast strip, rolling the as-cast strip to form an intermediate gauge sheet article, annealing the intermediate gauge sheet article, and cold rolling the intermediate gauge sheet article to a fin stock sheet material of final gauge, wherein the alloy is subjected to an average cooling at a rate of at least 300° C. second, more preferably at least 500° C./second, during the continuous casting step.

The alloy is preferably subjected to a thickness reduction of at lean 45% during the cold-ling step following the interanneal.

Preferably, the continuous casting step is carried out by twin-rolling casting that produces a rate of cooling falling within the desired range.

The invention also relates to aluminum alloy finstock material produced by the process of the invention.

The alloys to which the present invention relates are those of the following general composition (in percent by weight):

| | |
|---|---|
| Fe | 1.2 to 2.4 |
| Si | 0.5 to 1.1 |
| Mn | 0.3 to 0.6 |
| Zn | 0 to 1.0 |
| Ti (optional) | 0.005 to 0.040 |
| Incidental elements | less than 0.05 each, total ≦0.15 |
| Al | balance. |

More preferably, the alloys of the invention have the following composition in percent by weight:

| | |
|---|---|
| Fe | 1.3–1.8 |
| Si | 0.5–1.0 |
| Mn | 0.3–0.6 |
| Zn | 0–0.7 |

-continued

| | |
|---|---|
| Ti | 0.005–0.0.020 |
| Incidental elements | less than 0.05 each, total ≦0.15 |
| Al | balance. |

Preferably, in order to obtain a fin stock sheet material of good strength after brazing (high ultimate tensile strength—UTS), the cold rolling of the intermediate gauge strip following the annealing step is carried out to the extent that the intermediate gauge sheet is subjected to a thickness reduction of at least 45%, and preferably at least 60%, to a final gauge of 100 μm or less, preferably 80 μm or less and most preferably 60 μm ±10%.

The present invention relates to a process of producing a fin stock material that gives good corrosion protection for a heat exchanger using such fin material, and that is suitable for manufacturing brazed heat exchangers using thinner fins than previously possible. This is achieved while retaining adequate strength and conductivity in the fins to permit their use in heat exchangers.

The strip product formed from this alloy according to the present invention has a strength (UTS) after brazing greater than about 127 MPa, preferably greater than about 130 MPa, a conductivity after brazing greater than 49.0% IACS, more preferably greater than 49.8% IACS, most preferably greater than 50.0% IACS, and a brazing temperature greater than 595° C., preferably greater than 600° C.

These strip properties are measured under simulated brazed conditions as follows.

The UTS after brazing is measured according to the follow procedure that simulates the brazing conditions. The processed fin stock in its find as rolled thickness (e.g. after rolling to 0.06 mm in thickness) is placed in a furnace preheated to 570° C. then heated to 600° C. in approximately 12 minutes, held (soaked) at 600° C. for 3 minutes, cooled to 400° C. at 50° C./min. then air-cooled to room temperature. The tensile test is then performed on this material.

The conductivity after brazing is measured as electrical conductivity on a sample processed as far the UTS test which simulates the bring conditions, using conductivity tests as described in JIS-N0505.

The corrosion potential is measured on a sample processed as for the UTS test using tests as described in ASTM G3–89, using an Ag/AgCl/sat.KCl reference electrode.

DETAILED DESCRIPTION OF THE INVENTION

Figure 1:
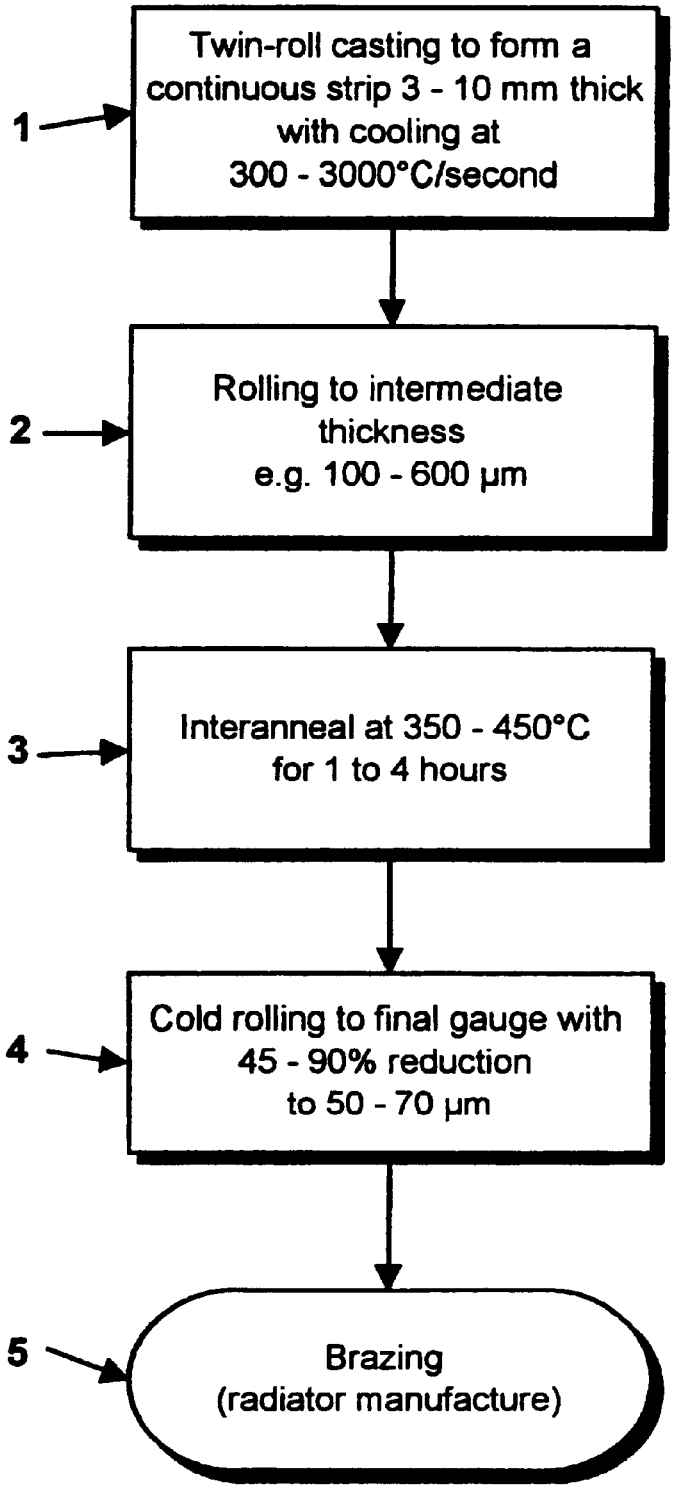
FIG. 1 is a flow chart illustrating steps in a preferred form of the process of the invention.

As noted above, the present invention is based on the unexpected finding that the conditions under which a finstock alloy is cut, particularly the rate of cooling during the casting step, may affect particular physical properties of the finstock product, notably its corrosion potential and also its thermal conductivity. The invention can therefore be used to improve these properties for a given finstock alloy without adversely affecting other desirable properties to a significant extent, such as brazeability and strength after brazing, although it may be advantageous to employ particular rolling steps after annealing in order to ensure high strength (as will be explained later).

In the past, finstock sheet materials have been produced using a number of methods including direct chill (DC) casting for which the cooling rate is relatively low.

However, high cooling rates can be achieved during certain methods of continuous casting. For example, when an alloy is cast by means of a twin-roll caster, for casting a continuous strip having a thickness of 3 to 10 mm, the twin-roll cuter normally imposes a cooling rate of 300–3000° C./second, and it has been found advantageous to cast alloys of the present invention at these high cooling rates to obtain significantly lower corrosion potentials and/or higher thermal conductivities. Although twin roll casting is most frequently used to achieve these high cooling rates, any form of continuous strip caster meeting these requirements may be used.

The reason why a significantly faster cooling rate during casting should affect the corrosion potential and also the thermal conductivity of a finstock alloy is not precisely know it The change in corrosion potential is particularly marked and is especially surprising. The corrosion potential of a finstock material is normally associated with the Zn content of the alloy, and higher concentrations of Zn lead to a more negative corrosion potential value. However, with the present inventional a lower improved corrosion potential may be obtained at any concentration of Zn, and an improvement is seen even if no Zn is present. This effect can therefore be used to lower the content of Zn in the alloy while maintaining an original corrosion potential. Alternatively, the Zn content of an alloy may be kept the same or raised, and the corrosion potential may be made more negative by an amount greater than can be attributed to the increases of Zn content increase alone.

The effect of twin-roll casting on thermal conductivity is also surprising, especially in view of the fact that conductivity normally decreases as the content of solutes in the alumninum matrix of a finstock alloy increases. A rapid cooling during casting, e.g. as noted for twin-roll casting, would be expected to increase the content of solutes in the metal matrix by forming a more supersaturated solution. Thermal conductivity might therefore be expected to decrease, whereas the opposite is found to be the case.

Despite these advantages, the more rapid cooling rate employed in the preset invention during casting may in some alloys tend to produce a fin stock material having a larger grain size than is generally the case for a fin stock material made by a process involving a slower rate of cooling, e.g twin-belt casting. If the larger grain size is allowed to persist in the alloy, the strength of the finstock material after brazing may be lower than that of an equivalent twin-belt cast product. Accordingly, the as-cast strip produced according to the present invention is desirably subjected to a high degree of cold work (cold rolling) after the interanneal to reduce the grain size. Preferably, the strip of intermediate gauge (which has a thickness in the range of 100 to 600 μm) following the interannneal is reduced in thickness to final gauge by an amount in the range of at least 45%, more preferably at least 60%, and most preferably at least 80% (e.g. 80–90%). Conventional finstock material usually had a thickness of 80–100 μm, but thinner gauge finstock alloys are now desired, e.g. having a thickness of 60 μm±10% . The thickness reduction required during the rolling procedure can be established from the degree of cold rolling required after the interanneal and the desired final gauge. For example, to produce a finstock material with 90% cold reduction and a final thickness of 60 μm, the intermediate gauge strip following the inter anneal would have to have a thickness of about 600 μm, so the rolling prior to the interanneal would be carried out to establish this degree of reduction from the thickness of the as-cast strip (normally 6–8 mm).

In processes of continuous casting, the average cooling rate generally means the cooling rate averaged through the thickness of the as-cast strip. The cooling rate to which a particular metal sample has been subjected due casting can be determined from the average interdendritic cell spacing as described, for example, in an article by R. E. Spear, et al. in the Transactions of the American Foundrymen's Society, Proceedings of the Sixty-Seventh Annual Meeting 1963, Vol. 71, Published by the American Foundrymen's Society, Des Plaines, Ill. USA, 1964, pages 209 to 215 (the disclosure of which is incorporated herein by reference). By measuring samples taken from points through the thickness of the strip, an average can be established. When casting is carried out by twin-roil casing, a degree of hot rolling takes place during casting and the dendrite structure may become somewhat compressed or deformed. The dendritic arm spacing method may still be employed in these circumstances, but is generally not required for two reasons. Firstly, it can normally be assumed that casting in twin-roll caster causes cooling at rates greater than 300° C./second. Secondly, the twin-roll casting process creates an as-cast strip in which the temperatures do not differ greatly from the surface to the interior at the outlet of the caster. Surface temperatures may therefore be taken as average strip temperatures.

Continuous as-cast strip of the present invention having a thickness of 10 mm or less can generally be reduced in thickness by cold rolling alone. However, it may be advantageous to use some, hot rolling to reduce the strip thickness and the reduction in gauge from the as-cast condition (3 to 10 mm thick) to the intermediate gauge prior to the interanneal step (100 to 600 $\mu$m thick) can be accomplished by cold rolling alone or optionally by a combination of hot and cold rolling steps. However, unlike DC cast ingots, the hot rolling step does not use any prior homogenization step. The hot rolling step, when used, will preferably reduce the thickness of the strip to less than 3.0 mm.

The alloy ingredients have been described above. The properties introduced by the various elements are discussed below.

The iron in the alloy forms intermetallic particles during casting that are relatively small and contribute to particle strengthening. With iron contents below 1.2 wt. %, there is generally insufficient iron to form the desired number of strengthening in particles, while with iron contents above 2.4 wt. %, large primary intermetallic phase particles may be formed which prevent rolling to the desired very thin fin stock gauges. The onset of formation of these particles is dependent on the exact conditions of casting used, and it is therefore preferable to use iron in an amount of less than 1.8 wt. % to ensure good material under the widest possible processing conditions.

The silicon in the alloy in the range of 0.5 to 1.1 wt. % contributes to both particle and solid solution strengthening. Below 0.5 wt. % there is generally insufficient silicon for this strengthening purpose while above 1 wt. %, the conductivity may be reduced. More significantly, at high silicon contents, the alloy melting temperature is reduced to the point at which the material cannot be brazed. To provide for optimum strengthening silicon in excess of 0.8 wt. % is particularly preferred.

When manganese is present in the range of 0.3 to 0.6 wt. %, it contributes significantly to the solid solution strengthening and to some extent to particle strengthening of the material. Below 0.3 wt. %, the amount of manganese is insufficient for the purpose. Above 0.6 wt. %, the presence of manganese in solid solution becomes strongly detrimental to conductivity.

The balance of iron, silicon and manganese contributes to the achievement of the desired strength, brazing performance and conductivity in the finished material.

The zinc content, which is optional but may be present in an amount up to 1.0 wt. %, provides for a lower (more negative) corrosion potential of the fin material. However, the process of the present invention decreases corrosion potential, so the amount of Zn may be reduced or eliminated, or kept the same while the corrosion potential is reduced. For many applications, there should be at least about 0.1 wt. % Zn present in the alloy. Above about 1 wt. % no commercially usefull corrosion potential is obtained.

The titanium, when present in the alloy as $TiB_2$, acts as a grain refiner during casting. When present in amounts greater than 0.04 wt. %, it tends to have a negative impact on conductivity.

Any incidental elements in the alloy should be less than 0.05 wt. % each and less than 0.15 wt. % in aggregate. In particular magnesium must be present in amounts of less than 0.10 wt. %, preferably less than 0.05 wt. %, to insure brazability by the Nocolok® process. Copper must be kept below 0.05 wt. % because it has a similar effect to manganese on conductivity and it also causes pitting corrosion.

A typical (preferred) casting, rolling and heat treatment process according to the present invention, including final brazing is shown in FIG. 1 of the accompanying drawings. The drawing shows a first step 1 involving twin-roll casting to form a continuous as-cast strip 3–10 mm in thickness, involving cooling at a rate in the range of 300 to 3000° C./second. A second step 2 involves rolling the as-cast strip (by hot and/or cold rolling) to an intermediate thickness of 100–600 $\mu$m. A third step 3 involves an inteanneal of the strip of intermediate thickness at a temperatre in the range of 350–45° C. for 1 to 4 hours. Step 4 involves cold-rolling the interannealed strip to a final gauge fin stock sheet material, preferably with 45 to 900 % thickness reduction to a gauge of 50–70 $\mu$m. Step 5 is a brazing step carried out during the manufacture of a heat exchanger, e.g. an automobile radiator, during which the fin stock sheet material is attached to cooling tubes. This final step is normally carried out by a radiator manufacturer as indicated by the different shape of the border surrounding the step.

The casting step may be carried out in a variety of commercially available twin-roll casters. Such casters are manufactured, for example, by Pechiney or Fata-Hunter.

EXAMPLES

A casting trial was conducted with an alloy whose composition was as shown in Table 1 below.

TABLE 1

| Alloy Composition (wt. %) | | | |
|---|---|---|---|
| Fe | Mn | Si | Zn |
| 1.52 | 0.36 | 0.83 | 0.48 |

The alloy was cast on a laboratory-scale twin-roll caster. In the casting trial, strip samples were produced at four different speeds. The sample identifications and casting parameters are listed in Table 2 below. The average cooling rate (taken as the average through the as-cast strip thickness) was 930° C./second.

TABLE 2

| Sample ID | Strip Thickness (mm) | Strip Width (mm) | Tip Setback (mm) | Casting Speed (m/min) | Roll Force (tonnes) |
|---|---|---|---|---|---|
| TRC01 | 5.1 | 140 | 30 | 0.8 | 60 |
| TRC01 | 4.9 | 140 | 30 | 1.0 | 50 |
| TRC03 | 5.0 | 140 | 40 | 1.1 | 60 |
| TRC04 | 4.3 | 140 | 40 | 1.3 | 40 |

An alloy that had the same chemical composition (nominally the same composition) was also cast on a laboratory-scale belt caster. The actual composition in wt. % was Fe=1.41, Mn=0.39, Si=0.83, and Zn=0.51. The average cooling rate for the as cast strip was 53° C./second.

The twin-roll cast samples and the twin-belt cast samples were processed identically after casing, i.e. they were cold-rolled to 0.109 mm, interannealed at 400° C. for two hours, and cold rolled to the final gauge 0.06 mm. The final gauge fin stocks were subjected to a standard brazing test heating cycle, and then they were tested for conductivity and corrosion potential. The results are summared in Table 3 below.

TABLE 3

| Sample | Conductivity (% IACS) | Corrosion Potential (mV) |
|---|---|---|
| TRC01 | 52.3 | −778 |
| TRC02 | 52.3 | −784 |
| TRC03 | 52.4 | −784 |
| TRC04 | 52.0 | −777 |
| Belt Cast Material | 49.9 | −751 |

The results show that the twin-roll cast materials had a higher conductivity and a lower corrosion potential than the twin-belt cast materials.

What is claimed is:

1. A process of producing an aluminum alloy fin stock material from a finstock alloy, which comprises continuously strip casting the alloy to form an as-cast strip, rolling the as-cast strip to form an intermediate gauge sheet article, annealing the intermediate gauge sheet article, and cold-rolling the intermediate gauge sheet article to a fin stock sheet material of final gauge, wherein the process is carried out on an alloy which comprises 1.2 to 2.4 wt. % Fe, 0.5 to 1.1 wt. % Si, 0.3 to 0.6 wt. %, Mn, 0 to 1.0 wt. % Zn, optionally 0.005 to 0.040 wt. % Ti, less than 0.05 wt. % each of incidental elements, to a total of 0.15 wt. % or less, and the balance aluminum, and the continuous strip casting is carried out while cooling the alloy at a rate of at least 300° C./second.

2. The process of claim 1, wherein the alloy contains at least 0.1 wt. % Zn.

3. The process of claim 1, wherein the process is carried out on an alloy which comprises 1.3 to 1.8 wt. % Fe, 0.5 to 1.0 wt. % Si, 0.3 to 0.6 wt. % Mn, 0 to 0.7 wt. % Zn, 0.005 to 0.020 wt. % Ti, less than 0.05 wt. % each of incidental elements, to a total of 0.15 wt. % or less, and the balance aluminum.

4. The process of claim 1, wherein the alloy is cooled during casting at a rate of at least 500° C./second.

5. The process of claim 1, wherein the as-cast strip has a thickness of between 3 and 10 mm.

6. The process of claim 1, wherein the step of rolling the strip to an intermediate gauge is accomplished by a combination of hot rolling followed by cold rolling.

7. The process of claim 1, wherein the step of rolling the strip to an intermediate gauge is accomplished by cold rolling.

8. The process of claim 1, wherein the alloy is cast by twin-roll casting.

9. The process of claim 1, wherein the intermediate gauge sheet is cold rolled to the final gauge with a thickness reduction of at least 45%.

10. The process of claim 1, wherein the intermediate gauge sheet is cold rolled to the final gauge with a thickness reduction of at least 60%.

* * * * *